US005628544A

United States Patent [19]

Goodman et al.

[11] Patent Number: 5,628,544

[45] Date of Patent: May 13, 1997

[54] BEACHCHAIR AND COOLER COMBINATION

[75] Inventors: Rome A. Goodman; Michael S. Mundy, both of San Diego County, Calif.

[73] Assignee: Riptide Productions, Inc., San Diego, Calif.

[21] Appl. No.: 609,960

[22] Filed: Mar. 4, 1996

[51] Int. Cl.[6] ..... A47C 7/62

[52] U.S. Cl. ..... 297/188.14; 297/17; 297/440.24; 297/129; 297/188.19; 224/155; 224/156; 190/8

[58] Field of Search ..... 297/188.14, 17, 297/188.19, 440.24, 42, 44, 183.5, 129; 224/155, 156; 190/2, 8

[56] References Cited

U.S. PATENT DOCUMENTS

| | | | |
|---|---|---|---|
| 3,179,465 | 4/1965 | Roberts | 190/8 X |
| 3,828,992 | 8/1974 | Cerchione | 224/156 |
| 4,191,420 | 3/1980 | Fassett et al. | 297/17 X |
| 4,773,708 | 9/1988 | Nastu | 297/17 X |
| 4,784,436 | 11/1988 | Sutherland | 297/440.24 |
| 4,890,882 | 1/1990 | Harrington | 297/17 X |
| 4,955,517 | 9/1990 | Maresca | 297/120 X |
| 4,974,870 | 12/1990 | Jarke et al. | 297/17 X |
| 5,318,342 | 6/1994 | Hale | 297/17 X |
| 5,350,215 | 9/1994 | DeMars | 297/188.14 |
| 5,409,291 | 4/1995 | Lamb et al. | 297/188.14 X |

*Primary Examiner*—Peter M. Cuomo
*Assistant Examiner*—Rodney B. White
*Attorney, Agent, or Firm*—Henri J. A. Charmasson; John D. Buchaca

[57] ABSTRACT

Twin, thermal-insulated containers held side-by-side for transportation separate to expose deployable pairs of forward projecting and rearward projecting arms that mount a body-supporting web, thus forming a lounge chair whose thermal-insulated containers constitute the sides and arm rests. The arms are connected to toroidal bearings nested in semi-circular cavities in the walls of the containers. Detent nibs projecting from the periphery of the toroidal bearings engage corresponding notches in the bearing cavities when in their deployed lounge chair positions. The body-supporting web and the cross-bar joining the arms can be conveniently stored under the thermal-insulated containers when they are joined together in the transport mode.

12 Claims, 4 Drawing Sheets

BEACHCHAIR AND COOLER COMBINATION

FIELD OF THE INVENTION

This invention relates to collapsible lounge chairs for outdoor use and to portable ice chests.

BACKGROUND OF THE INVENTION

The two most commonly used devices for recreational purposes on beaches, parks and around swimming pools are lounge chairs and portable ice boxes. Lounge chairs even foldable ones tend to be bulky, and not always adjustable to a variety of lounging positions. Portable ice boxes are also bulky and seem always to compete for space in the truck of ones car with the lounge chair, parasol, beachballs and other items usually taken to a beach or poolside.

There is a need for compatible and preferably integrated lounge chairs and ice boxes which could be stored together into a relatively small, easy to carry package.

SUMMARY OF THE INVENTION

The principal and secondary objects of the inventions are to provide an integrated package combining a portable ice box with a comfortable and multi-position lounge chair to be carried together to beaches, parks, poolsides and other such recreational sites.

These and other objects are achieved by combining two oblong thermal insulated containers which can be conveniently carried together side-by-side, then separated to expose two pairs of deployable forward projecting and rearwardly projection arms between which can be hung a body-supporting web. A foldable member is provided to position the two thermal insulated containers in a spaced-apart parallel relationship where they can form the side and arm rests of the lounge chair. The web-supporting arms are rotatively connected to the interfacing walls of the containers by toroidal bearings which include resiliently compressible nibs which can be releasably engaged into notches in the container walls to immobilize the arms in their deployed positions.

The web and cross-bar which link the arms can be conveniently stowed under the thermal-insulated containers in their transport position.

DESCRIPTION OF THE PREFERRED EMBODIMENT OF THE INVENTION

Figure 1:
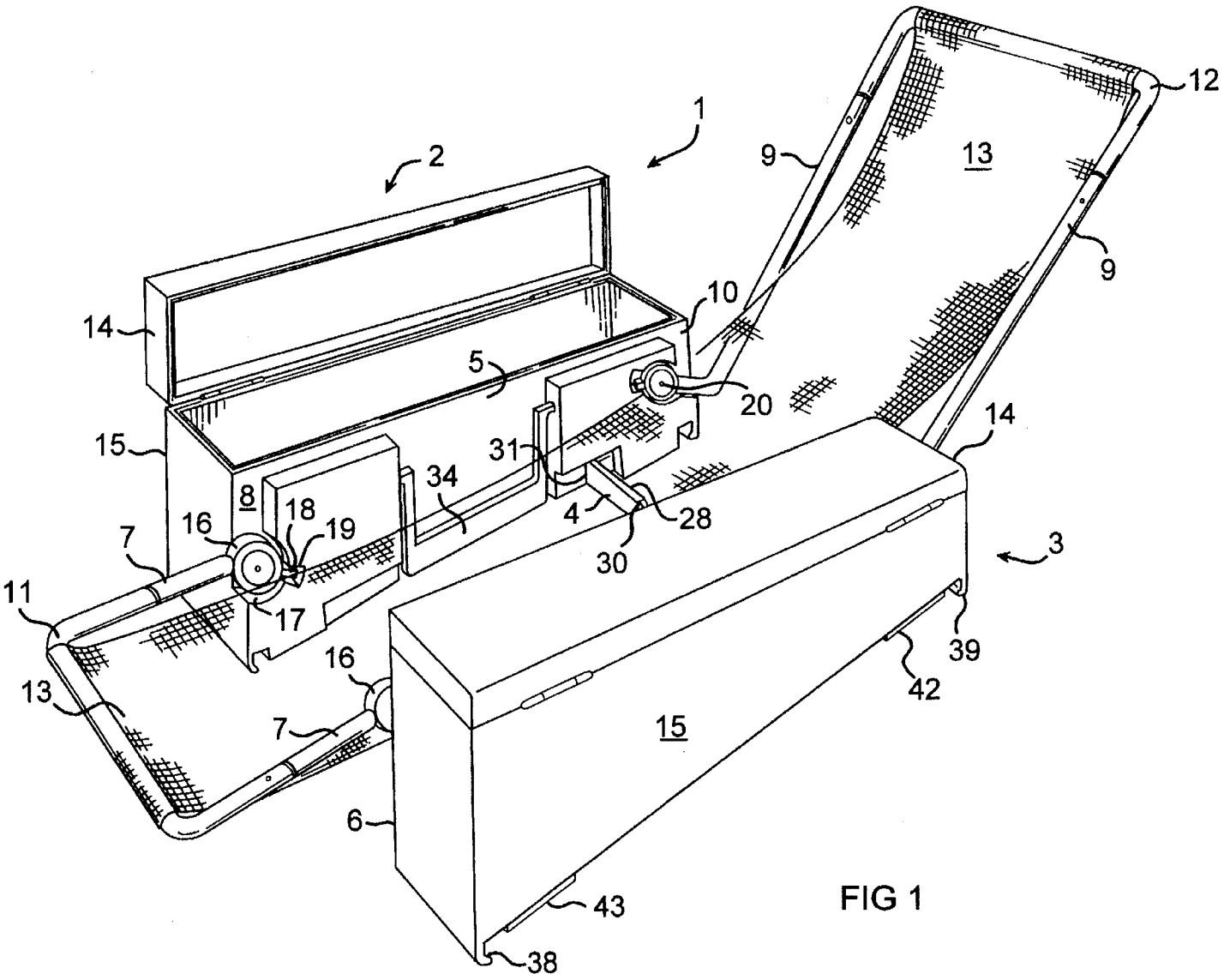
FIG. 1 is a perspective view of the beachchair and cooler combination in its fully deployed state.
Figure 2:
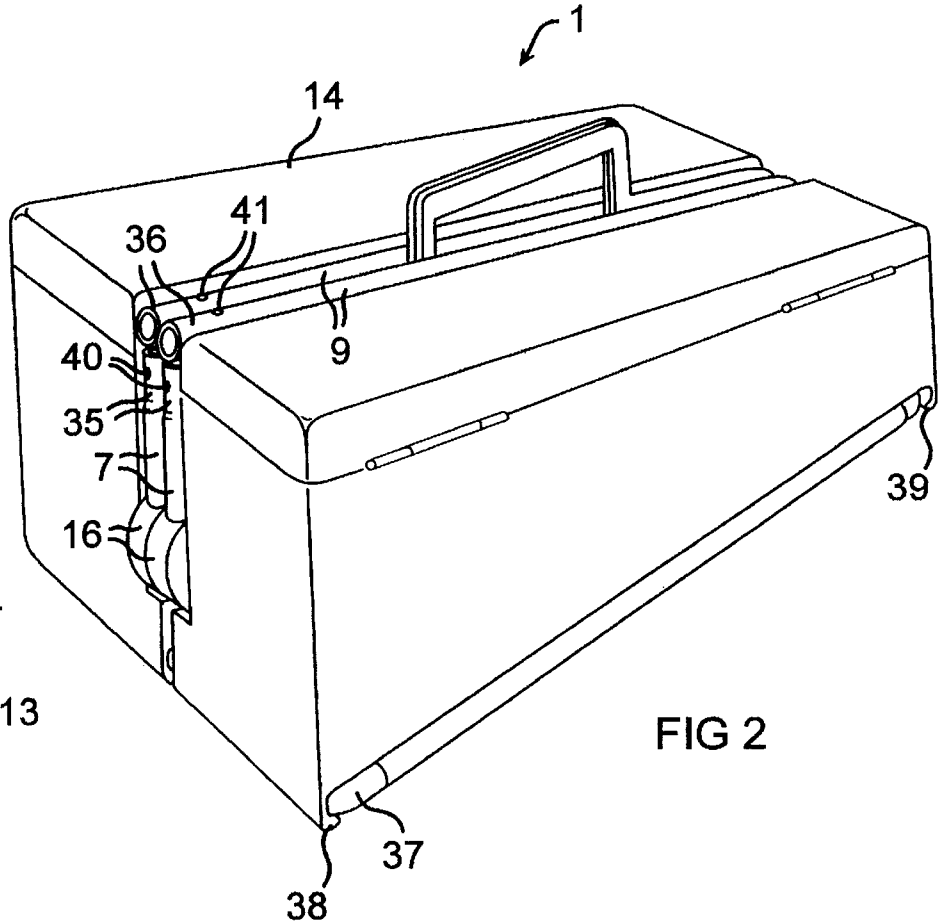
FIG. 2 is a perspective view in the folded, transport position.
Figure 3:
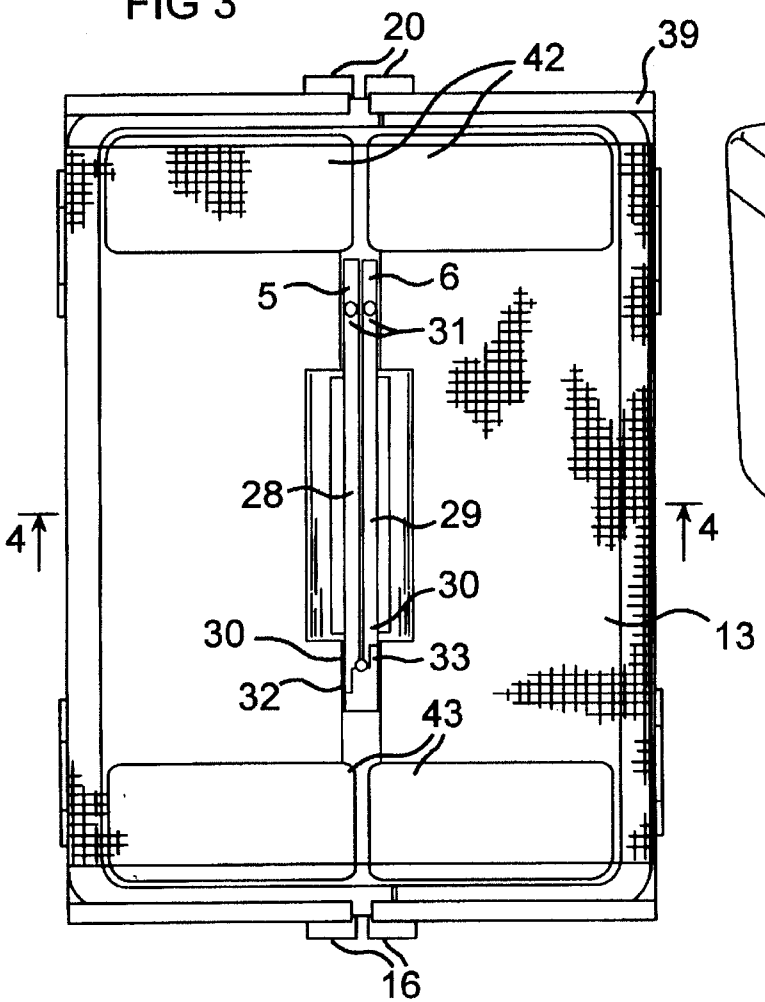
FIG. 3 is a top bottom view thereof.
Figure 4:
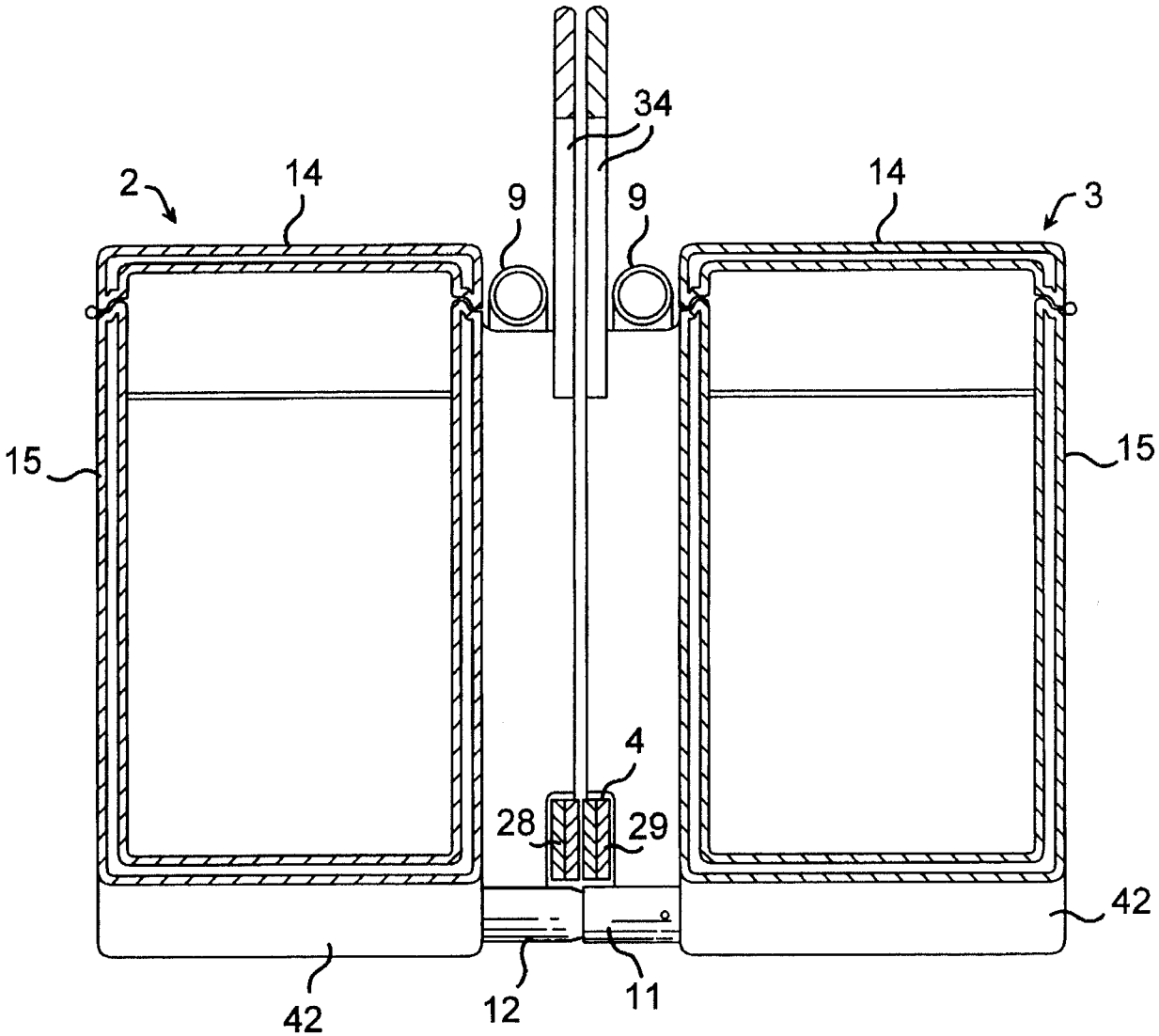
FIG. 4 is a cross-sectional view taken along line 4—4 of FIG. 3.

Referring now to the drawing, there is shown a lounge chair whose sides and arm rests are constituted by two thermal insulated oblong containers 2, 3. The containers are held in a stable, parallel and spaced-apart relationship by means of a foldable bar 4 hingedly secured to the lower part of their interfacing lateral walls 5, 6. The left-hand container 3 is a mirror image of the right-hand container 2. A first collapsible arm 7 is attached to the front section 8 of each container's inner wall 5, 6. The arm 7 can be oriented to extend forwardly as shown on FIG. 1, or may be withdrawn to a vertical stowed away position as illustrated in FIG. 2. A second collapsible arm 9 is secured to the back section 10 of each of the lateral walls 5, 6. This second arm can be rotated from a plurality of rearward projection positions, one of which is illustrated in FIG. 1, to a stowed away, horizontal position as illustrated in FIG. 2. A first U-shaped cross bar 11 joins the forward projecting arms 7. A second, similarly shaped cross bar 12 joins the rearward projecting arms 9. A body-supporting web 13, shown partly transparent for the sake of clarity in FIGS. 1 and 3, spans the two cross bars 11, 12. Each container 2, 3 has its open top covered by a lid 14 hinged to the top of its outer wall 15. As shown in FIG. 4, the containers have a double-wall shell construction with a dead airspace in between for better thermal insulation.

If each forward extending arm 7 is mounted on a toroidal bearing 16 nested in a semi-circular cavity 17 practiced into the inner wall 5, 6 of the container. A nib 18 which is resiliently biased to extend radially and centrifugally from the periphery of the toroidal bearing 16 extends into a notch or depression 19 of the semi-circular cavity when the arm 7 is in its deployed position. In order to return the arm 7 to its stowed position it is necessary to depress the nib 18 in order to free it from the notch 19.

Figure 5:
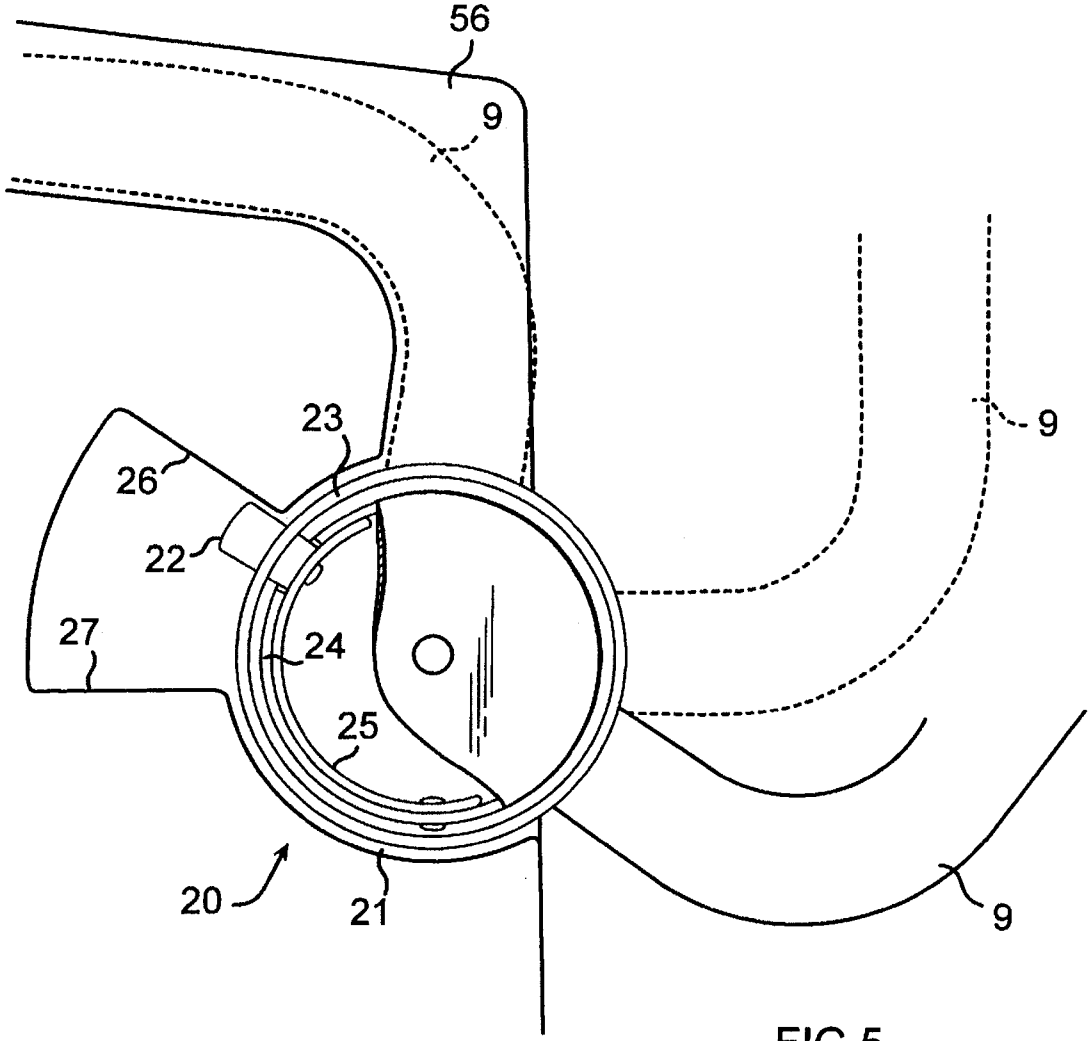
FIG. 5 is a front view of the toroidal bearing.

Each rearward projecting arm 9 is similarly connected to a toroidal bearing 20 more specifically illustrated in FIG. 5. The bearing 20 is also nested in a semi-circular cavity 21 of the inner wall 5, 6. A depressible nib 22 passes through apertures in the two walls 23, 24 of the toroidal bearing and is biased by a arcuate leaf spring 25 to resiliently extend into a wide-angle notch 26 in the periphery of the semi-circular cavity 21. When the nib 22 rests against the upper edge 27A of the notch the arm 9 is in a maximum reclining position. When the nib 22 rests against the lower edge 27B of the notch 26, the arm 9 is in a near vertical position. The user of the lounge chair can move from a sitting position to where the arm 9 is nearly vertical to the reclining position by simply shifting his upper torso backward. He can similarly return to a sitting position by bringing his upper torso forward. In order to flip the arm to his near-horizontal storage position shown in FIG. 2, the nib 22 must be depressed against the spring 25 to free it from the notch 26.

The spacing bar 4 is made of two equal sections 28, 29 which are hinged together at one of their respective ends 30, the opposite ends 31 are hingedly connected to one of the inner walls 5, 6 of one of the containers. A spur 32 projects from one of the two ends 30 of the spacing bar into a mortise 33 cut in the end of the other section when the spacing bar 4 is fully deployed in order to lock it in that position.

A handle 34 is rotatively mounted in the median section of each inner wall 5, 6 and oriented so that it can assume two positions. A first inactive position illustrated in FIG. 1 when the lounge chair is fully deployed, and an active position illustrated in FIGS. 2 and 4 when the lounge chair is folded back into its carrying mode.

The arms 7, 9 and cross bars 11, 12 are made of tubular stock and have telescopically engaging ends. As shown in FIG. 2, the forward projecting arms 7 have male-connecting ends 35, while the rearward projecting arms 9 have female-connecting ends 36. Accordingly, the forward cross bar 11 must have female-connecting ends, and the rearward cross bar 12 must have male-connecting ends. Detent nibs 40 on male couplings engaging bores 41 in female couplings lock the arms and cross bars together. In the transport mode, the two cross bars 11, 12 are interconnected to form a frame 37 around which the web 13 can be wrapped. The frame 37 and web assembly can be conveniently tucked under the collapsed lounge chair package as illustrated in FIGS. 2 and 3. The frame 37 is immobilized between hook-like downward projections 38, 39 at the base of the front and back walls of each container. The frame clamps together the two pairs of container's feet 42, 43, thus preventing the containers from separating during transportation.

It can now be understood that the invention provides a package combining two thermal insulated containers and a folded lounge chair that can be easily carried or stowed in the trunk of a car. Once deployed, the device offers a comfortable, multi-position recliner and cooler combination ideal for use on beaches, in parks, at poolside in connection with a multitude of recreational activities.

While the preferred embodiments of the invention have been described, modifications can be made and other embodiments may be devised without departing from the spirit of the invention and the scope of the appended claims.

What is claimed is:

1. A lounge chair which comprises:

a first oblong container having a substantially flat vertical, lateral first wall;

a second oblong container substantially symmetrical with, and movable in relation to said first container and having a substantially flat, vertical, lateral second wall;

collapsible means for, in a deployed state, maintaining said containers in a stable, parallel, spaced-apart position in relation to each other wherein said first wall distantly faces said second wall and for, in a folded state, hold said containers in a joint position wherein said first wall abuts said second wall;

each of said containers having a collapsible first arm extending forwardly and a collapsible second arm extending rearwardly astride one of said lateral walls;

a body-supporting web; and means for suspending said web between said collapsible arms.

2. The lounge chair of claim 1, wherein said means for suspending comprise:

a first cross-bar joining said forwardly extending arms; and a second cross-bar joining said rearwardly extending arms.

3. The lounge chair of claim 2, which further comprises means for stowing said cross-bars, and said web together under said containers when said first and second walls are held in said joint position.

4. The lounge chair of claim 1, which further comprises means for rotatively connecting one end of each of said collapsible arms to one of said lateral walls.

5. The lounge chair of claim 4, wherein said container comprises a thermal insulated shell.

6. The lounge chair of claim 5, wherein each of said containers comprises a lid extending over an upper section of said container.

7. The lounge chair of claim 6, which further comprises a pair of foldable handles, each one of said handles being connected to one of said containers.

8. The lounge chair of claim 7, wherein each one of said handles is rotatively attached to one of said walls and oriented to be raised in a deployed first position above said wall, and be lowered in a stowed second position flatly against a lower portion of said wall.

9. The lounge chair of claim 4, wherein each of said means for rotatively connecting comprises means for locking said arms in an extended position.

10. The lounge chair of claim 9, wherein said collapsible means for maintaining comprises:

a folding bar including two substantially equal length sections, each of said sections having first and second ends; and means for hingedly connecting the first end of each of said sections together, and means for hingedly connecting the second end of each of said sections to one of said containers.

11. The lounge chair of claim 9, wherein said means for rotatively connecting comprises:

a toroidal bearing rotatively and concentrically mounted in a cavity of one of said walls;

means for radially connecting one of said arms to said bearing;

said cavity having a lateral depression;

a resiliently compressible lug extending radially and centrifugally through a peripheral aperture in said toroidal bearing distally from said means for radially connecting, into a portion of said depression;

thereby locking said toroidal bearing into a deployed position.

12. The lounge chair of claim 11, wherein said means for suspending comprises a first cross-bar joining said forwardly extending arms, and a second cross-bar joining said rearwardly extending arms; and wherein each of said second arms comprises a first end permanently secured to one of said toroidal bearings, and a second end releasably attachable to one of said cross-bars.

* * * * *